US011350201B2

(12) United States Patent
Tseng et al.

(10) Patent No.: US 11,350,201 B2
(45) Date of Patent: May 31, 2022

(54) HEADBAND STRUCTURE FOR HEADPHONES

(71) Applicant: Cheng Uei Precision Industry Co., LTD., New Taipei (TW)

(72) Inventors: Chi-Ming Tseng, New Taipei (TW); Chin-Chung Lin, New Taipei (TW)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 17/232,135

(22) Filed: Apr. 15, 2021

(65) Prior Publication Data

US 2022/0078536 A1 Mar. 10, 2022

(30) Foreign Application Priority Data

Sep. 8, 2020 (CN) ..... 202021953209.7

(51) Int. Cl.
*H04R 1/00* (2006.01)
*H04R 1/10* (2006.01)

(52) U.S. Cl.
CPC ..... *H04R 1/105* (2013.01); *H04R 1/1008* (2013.01); *H04R 1/1066* (2013.01)

(58) Field of Classification Search
CPC ..... H04R 1/10; H04R 1/1075; H04R 1/1008; H04R 1/1033; H04R 1/1066; H04R 5/033; H04R 5/0335; H04R 2420/07; H04R 2420/09; H04R 7/00
See application file for complete search history.

(56) References Cited

U.S. PATENT DOCUMENTS 4,499,593 A * 2/1985 Antle ..... H04R 1/1066 381/378
2003/0210801 A1* 11/2003 Naksen ..... H04R 1/1066 381/376

FOREIGN PATENT DOCUMENTS

CN 208940168 U 6/2019

* cited by examiner

*Primary Examiner* — Amir H Etesam
(74) *Attorney, Agent, or Firm* — Cheng-Ju Chiang

(57) ABSTRACT

A headband structure for headphones, comprising: a headband set, and an adjustment module arranged at an end of the headband set, wherein the adjustment module includes: an earphone hanger which is consisted of a hanger frame, a fixing base arranged at an end of the hanger frame, a spring arranged on the fixing base and a convex face arranged on the spring, a first cap body arranged at a side of the earphone hanger, a wave form fastener arranged on the first cap body to contact with the convex face, a second cap body arranged at another side of the earphone hanger, and a sliding space formed between the first cap body and the second cap body for accommodating an end of the earphone hanger.

10 Claims, 8 Drawing Sheets

HEADBAND STRUCTURE FOR HEADPHONES

CROSS-REFERENCE TO RELATED APPLICATION

The present application is based on, and claims priority from, China Patent Application No. 202021953209.7, filed Sep. 8, 2020, the disclosure of which is hereby incorporated by reference herein in its entirety.

BACKGROUND OF THE INVENTION

1. Field of the Invention

The present invention relates to a headphone, in particular to a headband structure of the headphone.

2. The Related Art

The existing earphones have variety types such as earbuds, in-ear earphones, over-head headphones, etc. And the over-head headphones is able to cover a user's ear completely, which makes the over-head headphones more comfortable to wear in compared with other type of earphones. Besides, the headband of an over-head headphones is adjustable to fit every user.

The china patent No. 208940168 discloses "A kind of stretching structure of headphone" which includes lid and telescopic component, the lid includes upper cover body and lower cover, the lower cover is equipped with sliding groove, the telescopic component is slidably mounted in sliding groove, the slot bottom of the sliding groove is arranged at intervals with convex block, clamping position is formed between adjacent two convex block, the telescopic component includes headband, extensible member and elastic slice, the headband is fixedly installed in the top of extensible member, the elastic slice includes protrusion, buffer part and hook portion, the extensible member is equipped with through slot and mounting blocks, the protrusion stretches out in through slot, and the protrusion is fastened in clamping position, the hook portion grab is in mounting blocks, the upper surface of the buffer part is abutted with the lower surface of headband, the extensible member is equipped with limit hook.

However, the elastic slice in the headphone is secured between the headband and the telescopic component, and the headband slides via the structure of the upper cover body and the lower cover body, and thus the headband will be partially deformed and wear the fastening point of the elastic slice after a period of use, which affects the feel of touch.

Therefore, it is necessary to provide a headband structure of the headphone which doesn't affect the feel of touch caused by deformation of the headband.

SUMMARY OF THE INVENTION

The objective of the present invention is to provide a headband structure of the headphone which doesn't affect the feel of touch caused by deformation of the headband.

A headband structure for headphones, comprising: a headband set, and an adjustment module arranged at an end of the headband set, wherein the adjustment module has an earphone hanger which has a hanger frame, a fixing base arranged at an end of the hanger frame, a spring arranged on the fixing base and a convex face arranged on the spring, a first cap body arranged at a side of the earphone hanger, a wave form fastener arranged on the first cap body to contact with the convex face, a second cap body arranged at another side of the earphone hanger, and a sliding space formed between the first cap body and the second cap body for accommodating the end of the earphone hanger.

In a preferred embodiment, wherein a plurality of positioning holes are formed on the spring, a plurality of positioning pillars are arranged on the fixing base, and the positioning pillars go through the positioning holes.

In a preferred embodiment, wherein a slot is formed at the end of the hanger frame, the fixing base is arranged next to the slot, a protrusion is extended toward the first cap body from an inner surface of the hanger frame, the protrusion is formed in a rectangular shape and arranged to surround the slot, a plurality of positioning hooks are extended toward the first cap body from an inner surface of the fixing base and the positioning hooks are clipped on left and right sides of the protrusion for securing the fixing base on the hanger frame.

In a preferred embodiment, wherein at least a first stop block is extended toward the first cap body from an end of the protrusion, and at least a second stop block is extended toward the hanger frame from a side of an inner surface of the first cap body to mate with the first stop block.

In a preferred embodiment, wherein the first cap body has a stopper rib, a glide groove, the wave form fastener, a plurality of first glide ribs, a plurality of multi-level holes, a plurality of first positioning parts and a through hole, the stopper rib is arranged at a middle of the first cap body, the stopper rib has a front wall extended toward the hanger frame and opposite sidewalls extended toward the hanger frame, the front wall and the sidewalls are cooperated with each other to form the glide groove, the end of the earphone hanger is arranged to mate the glide groove, the first glide ribs are extended toward the hanger frame and extended longitudinally along the first cap body and extended inside the glide groove, the wave form fastener is arranged between the first glide ribs, the first glide ribs are arranged on an inner side of the sidewalls, the multi-level holes are recessed toward the hanger frame from front and rear ends of an outer surface of the first cap body, the first positioning parts are extended toward the hanger frame from an inner surface of the first cap body, the first positioning parts are arranged between the multi-level holes, the first positioning parts are formed as hollow cylinders, the through hole is formed at a side surface of the first cap body.

In a preferred embodiment, wherein the second cap body includes a plurality of second positioning parts, a plurality of third positioning parts, a plurality of positioning perforations, a plurality of second glide ribs, and a plurality of third glide ribs, the second positioning parts are extended toward the hanger frame from opposite sides of an inner surface of the second cap body to mate with the first positioning parts, the third positioning parts are extended toward the hanger frame from the opposite sides of the inner surface of the second cap body, the positioning perforations are formed to pass through the opposite sides of the inner surface of the second cap body, the third positioning parts and the positioning perforations are arranged to mate with the multi-level holes, the second glide ribs are extended toward the hanger frame and extended longitudinally along the second cap body from the inner surface of the second cap body to be positioned between the second positioning parts and the third positioning parts, a tab is extended toward the second cap body from an outer surface of the fixing base to contact with the second glide ribs, the third glide ribs are extended toward the hanger frame and extended longitudinally along the second cap body from the inner surface of the second cap body, the second glide ribs are arranged at an inner side of the third glide ribs.

In a preferred embodiment, the headband structure further comprising a plurality of first fixing pieces arranged to pass through the second positioning parts to be fasten in the first positioning parts, and a plurality of second fixing pieces arranged to pass through the multi-level holes to be positioned in the third positioning parts and the positioning perforations.

In a preferred embodiment, wherein the headband set includes a headband, two fixing pieces and a protective pad, and the two fixing pieces are molded to an end of an inner surface of the headband, the protective pad is arranged to the other end of the inner surface of the headband, notches are recessed toward the hanger frame from left and right sides of an outer surface of the second cap body to be fasten with the fixing pieces, two mounting holes are formed respectively at left and right sides of the headband and positioned near the protective pad, the second fixing pieces are arranged to pass through the multi-level holes of the first cap body to enter the positioning perforations of the second cap body and to be fastened in the mounting holes of the mounting holes.

A headband structure for headphones, comprising: a headband set; and an adjustment module arranged at one end of the headband set, the adjustment module having a hanger frame, a fixing base arranged at one end of the hanger frame, a tab arranged at an outer surface of the fixing base, a spring arranged on an inner surface of the fixing base, which has a convex face, a first cap body arranged at an inner side of the hanger frame, a wave form fastener arranged on an inner side of the first cap body to contact with the convex face, a second cap body arranged at an outer side of the hanger frame, a plurality of glide ribs arranged at an inner surface of the second cap body to be contacted with the tab, and a sliding space formed between the first cap body and the second cap body for accommodating the end of the hanger frame, the fixing base, and the spring.

In a preferred embodiment, wherein a slot is formed at the end of the hanger frame, a protrusion is extended toward the first cap body from an inner surface of the hanger frame, the protrusion is formed in a circle shape and arranged to surround the slot, a plurality of positioning hooks are extended toward the first cap body from the inner surface of the fixing base and the plurality of positioning hooks are clipped on left and right sides of the protrusion, two positioning pillars are extended toward the first cap body from the inner surface of the fixing base and respectively arranged next to a front end and a rear end of the protrusion, two positioning holes are formed on the spring, the positioning pillars are arranged to pass through the positioning holes of the spring.

DETAILED DESCRIPTION OF THE PREFERRED EMBODIMENT

Figure 1:
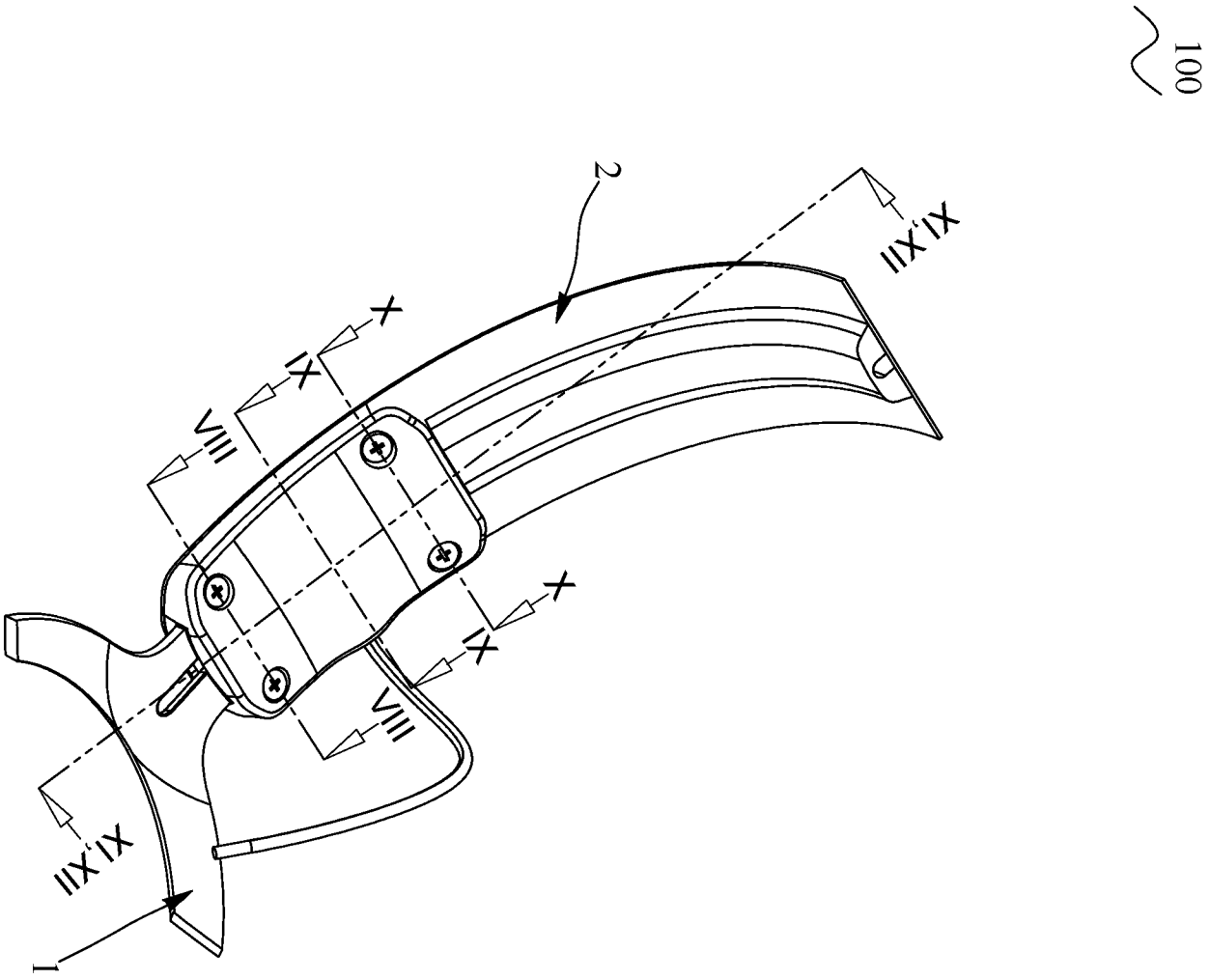
FIG. 1 is a perspective view of a headband structure for headphones in this invention.

Referring to FIG. 1, a headband structure 100 for a headphone includes an adjustment module 1 and a headband set 2. The adjustment module 1 is secured at one end of an inner surface of the headband set 2.

Referring to FIG. 2 to FIG. 6, the adjustment module 1 includes a hanger frame 11, a fixing base 12, a spring 13, a first cap body 14, a second cap body 15, a cable 16, a plurality of first fixing pieces 17 and a plurality of second fixing pieces 18. The fixing base 12 is secured at one end of the hanger frame 11. The spring 13 is secured on the fixing base 12. The first cap body 14 is arranged above the second cap body 15 to form a sliding space between the first cap body 14 and the second cap body 15. The end of the hanger frame 11, the fixing base 12 and the spring 13 are arranged in the sliding space. The cable 16 is arranged to pass through a side of the first cap body 14 for being positioned in the first cap body 14. The first fixing pieces 17 are arranged to pass through an outer surface of the second cap body 15 and Several of the second fixing pieces 18 are arranged to pass through an outer surface of the first cap body 14, which secures the second cap body 15 to the first cap body 14 to form the adjustment module 1. Several of the second fixing pieces 18 are arranged to pass through the outer surface of the first cap body 14 to secure the adjustment module 1 to the headband set 2 for forming the headband structure 100 of the headphone of the present invention.

Figure 2:
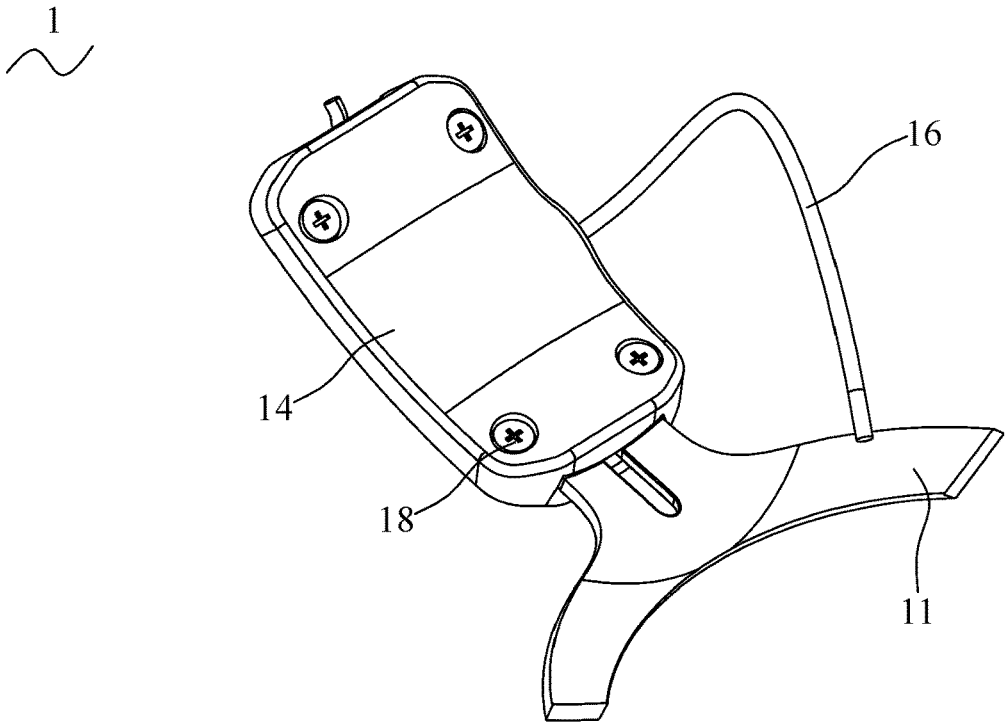
FIG. 2 is a perspective view of an adjustment module of the headband structure for headphones in this invention.
Figure 3:
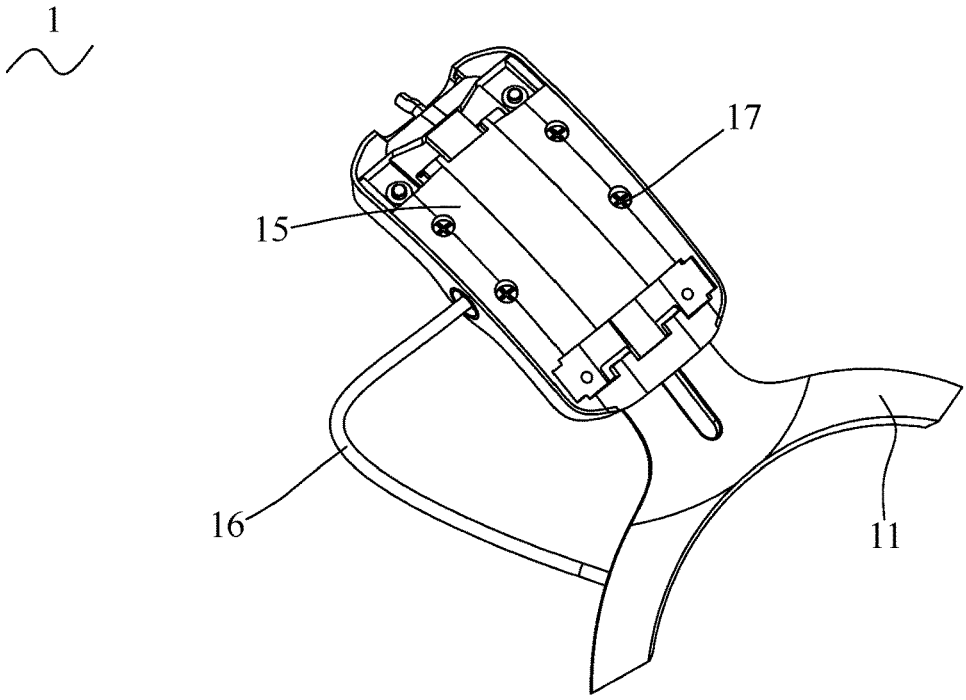
FIG. 3 is another perspective view of the adjustment module of the headband structure for headphones in this invention.

In this embodiment, the hanger frame 11, the fixing base 12 and the spring 13 are collectively referred as an earphone hanger 10, and an end of the earphone hanger 10 is arranged in the sliding space. The first cap body 14 is arranged above the earphone hanger 10, and the second cap body 15 is arranged below the earphone hanger 10. Reference is now made to FIG. 2 and FIG. 3, to be more specifically, the first fixing pieces 17 and the second fixing pieces 18 in this embodiment are screw bolts, and the quantity of the first fixing pieces 17 and the second fixing pieces 18 are four. The second cap body 15 is secured to the first cap body 14 with the first fixing pieces 17 and two of the second fixing pieces 18 which are positioned near the earphone hanger 10, to form the adjustment module 1 and to increase the structure strength. Referring to FIG. 1, the adjustment module 1 is secured to the headband set 2 with two of the second fixing pieces 18 which are positioned away from the earphone hanger 10, to form the headband structure 100 of the headphone of the present invention.

The hanger frame 11 includes a slot 111, a protrusion 112, and at least one first stop block 113. The slot 111 is formed at the end of the hanger frame 11 for holding the fixing base 12. The protrusion 112 is extended toward the first cap body 14 from an inner surface of the hanger frame 11. The protrusion 112 is formed in a rectangular shape or a circle shape and arranged to surround the slot 111. The first stop block 113 is extended toward the first cap body 14 from a rear end of the protrusion 112. In this embodiment, the hanger frame 11 has two the first stop blocks 113. When the adjustment module 1 is stretched until the first stop blocks 113 abut against the corresponding mechanism of the first cap body 14, the rear of the protrusion 112 abuts against a rear end of the first cap body 14 and stops the adjustment module 1 being stretched furthermore.

Figure 9:
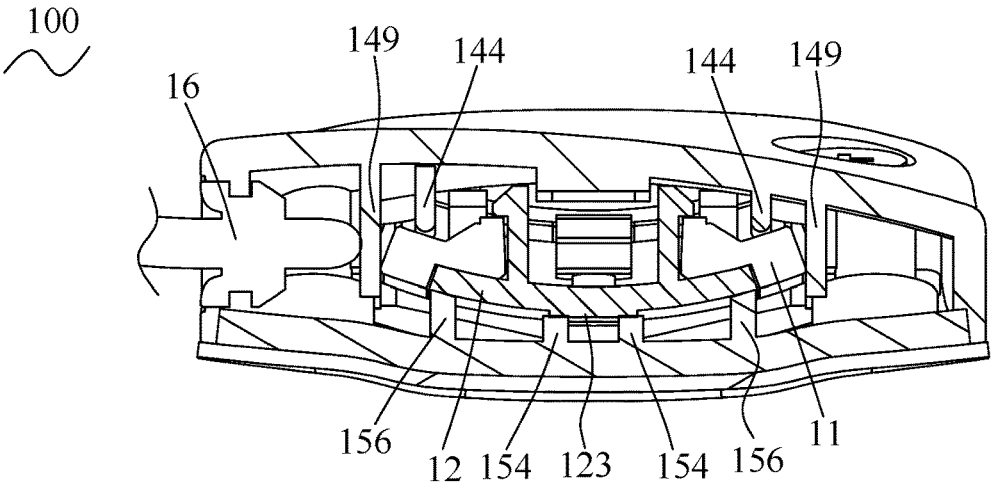
FIG. 9 is a sectional view of the headband structure for headphones along line IX-IX in FIG. 1.

The fixing base 12 is arranged next to the slot 111. The fixing base 12 includes a plurality of positioning hooks 121, two positioning pillars 122 and a tab 123. The positioning hooks 121 are extended toward the first cap body 14 from an inner surface of the fixing base 12 and the positioning hooks 121 are clipped on left and right sides of the protrusion 112 for securing the fixing base 12 on the hanger frame 11. The positioning pillars 122 are extended toward the first cap body 14 from the inner surface of the fixing base 12 and respectively arranged next to a front end and the rear end of the protrusion 112. The positioning pillars 122 are arranged to fasten the corresponding structure of the spring 13 for securing the spring 13 on the fixing base 12. The tab 123 is extended toward the second cap body 15 from an outer surface of the fixing base 12, and as shown in FIG. 9, the tab 123 is arranged to contact with a corresponding structure of the second cap body 15 for ensuring the spring 13 to contact with a corresponding structure of the first cap body 14.

The positioning hooks 121 pass through the slot 111 from an outer surface of the hanger frame 11 and then extend beyond the inner surface of the hanger frame 11, and the positioning hooks 121 are clipped on the left and right sides of the protrusion 112. In this embodiment, the quantity of the positioning hooks 121 is four and the positioning hooks 121 are lined up into two rows, and the two positioning pillars 122 are arranged between the two rows of the positioning hooks 121.

The spring 13 includes a convex face 131 and two positioning holes 132. The convex face 131 is arranged to contact with a corresponding structure of the first cap body 14. In this embodiment, the tab 123 of the fixing base 12 is arranged to abut against a corresponding structure of the second cap body 15 and keep the convex face 131 of the spring 13 contacting with the corresponding structure of the first cap body 14. The feel of touch of the headband structure 100 is improved by enhancing the clamping point between the convex face 131 of the spring 13 and the corresponding structure of the first cap body 14. The positioning pillars 122 pass through the positioning holes 132 of the spring 13 for securing the spring 13 on the fixing base 12.

The first cap body 14 includes at least one second stop block 140, a stopper rib 141, a glide groove 142, a wave form fastener 143, a plurality of first glide ribs 144, a plurality of multi-level holes 145, a plurality of first positioning parts 146 and a through hole 147. The second stop block 140 is extended toward the hanger frame 11 from an inner surface of the first cap body 14. In this embodiment, the first cap body 14 has two the second stop blocks 140. The first stop blocks 113 are arranged to mate with the second stop blocks 140. When the adjustment module 1 is stretched until the first stop blocks 113 abut against the second stop blocks 140 of the first cap body 14, the rear end of the protrusion 112 abuts against the rear end of the first cap body 14 and stops the adjustment module 1 being stretched furthermore. The stopper rib 141 is arranged at a middle of the inner surface of the first cap body 14. The stopper rib 141 has a front wall 148 extended toward the hanger frame 11 and opposite sidewalls 149 extended toward the hanger frame 11. The front wall 148 is arranged to limit the position of the end of the earphone hanger 10, and the sidewalls 149 are arranged to limit the sliding direction of the earphone hanger 10. The front wall 148 and the sidewalls 149 cooperate with each other to form the glide groove 142, and the end of the earphone hanger 10 is arranged to mate the glide groove 142. The wave form fastener 143 is extended toward the hanger frame 11 and arranged inside the glide groove 142 to contact with the convex face 131 of the spring 13, which improves the feel of touch of the headband structure 100 by enhancing the clamping point between the convex face 131 of the spring 13 and the wave form fastener 143. The first glide ribs 144 are extended toward the hanger frame 11 and then extended longitudinally along the first cap body 14. In this embodiment, the wave form fastener 143 is arranged between the first glide ribs 144, and the first glide ribs 144 are arranged on an inner side of the sidewalls 149. The multi-level holes 145 are recessed toward the hanger frame 11 from front and rear ends of the outer surface of the first cap body 14. The second fixing pieces 18 are fastened in the multi-level holes 145. The first positioning parts 146 are extended toward the hanger frame 11 from the inner surface of the first cap body 14. The first positioning parts 146 are arranged between the multi-level holes 145. In this embodiment, the first positioning parts 146 are hollow cylinders. The through hole 147 is formed at a side surface of the first cap body 14. A fixing part 1402 is extended toward the hanger frame 11 from a front end of the inner surface of the first cap body 14. A first recess 1403 is recessed toward the first cap body 14 from the fixing part 1402, and a second recess 1404 is formed at the rear end of the first cap body 14. The cable 16 passes through the through hole 147 of the first cap body 14 to enter a storage space 1401 of the first cap body 14, then goes from the storage space 1401 between the side surface of the first cap body 14 and the sidewalls 149 to the storage space 1401 between the fixing part 1402 and the front wall 148 to be secured by the first recess 1403, and then passes through the second recess 1404 for securing the cable 16 within the first cap body 14.

The second cap body 15 includes a plurality of second positioning parts 151, a plurality of third positioning parts 152, a plurality of positioning perforations 153, a plurality of second glide ribs 154, two notches 155 and a plurality of third glide ribs 156. The second positioning parts 151 are extended toward the hanger frame 11 from opposite sides of an inner surface of the second cap body 15 and mated with the first positioning parts 146. The first fixing pieces 17 pass through the second positioning parts 151 and be fastened in the first positioning parts 146 for securing the first cap body 14 to the second cap body 15. The third positioning parts 152 are extended toward the hanger frame 11 from the opposite sides of the inner surface of the second cap body 15. The positioning perforations 153 are formed to pass through the opposite sides of the inner surface of the second cap body 15. The third positioning parts 152 and the positioning perforations 153 are arranged to mate with the multi-level holes 145. The second fixing pieces 18 pass through the multi-level holes 145 to be fastened in the third positioning parts 152 and the positioning perforations 153. The second glide ribs 154 are extended toward the hanger frame 11 and extended longitudinally along the second cap body 15 from the inner surface of the second cap body 15, and positioned between the second positioning parts 151 and the third positioning parts 152. The second glide ribs 154 are arranged to contact with the tab 123 of the fixing base 12 for keeping the convex face 131 of the spring 13 contacting with the wave form fastener 143 of the first cap body 14. The feel of touch of the headband structure 100 is improved by enhancing the clamping point between the convex face 131 of the spring 13 and the wave form fastener 143 of the first cap body 14. Referring to FIG. 9, the earphone hanger 10 is arranged among the first glide ribs 144, the second glide ribs 154 and the two sidewalls 149. The notches 155 are recessed toward the hanger frame 11 from left and right sides of the outer surface of the second cap body 15 to hold the corresponding structure of the headband set 2 for securing the adjustment module 1 to the headband set 2. The third glide ribs 156 are extended toward the hanger frame 11 and then extended longitudinally along the second cap body 15 from the inner surface of the second cap body 15, and the second glide ribs 154 are arranged at an inner side of the third glide ribs 156. The third glide ribs 156 are arranged to contact with the fixing base 12.

In this embodiment, the quantity of the first positioning parts 146, the second positioning parts 151 and the first fixing pieces 17 are all four, and the quantity of the third positioning parts 152, the positioning perforations 153, the second glide rib 154 and the third glide ribs 156 are all two.

Figure 7:
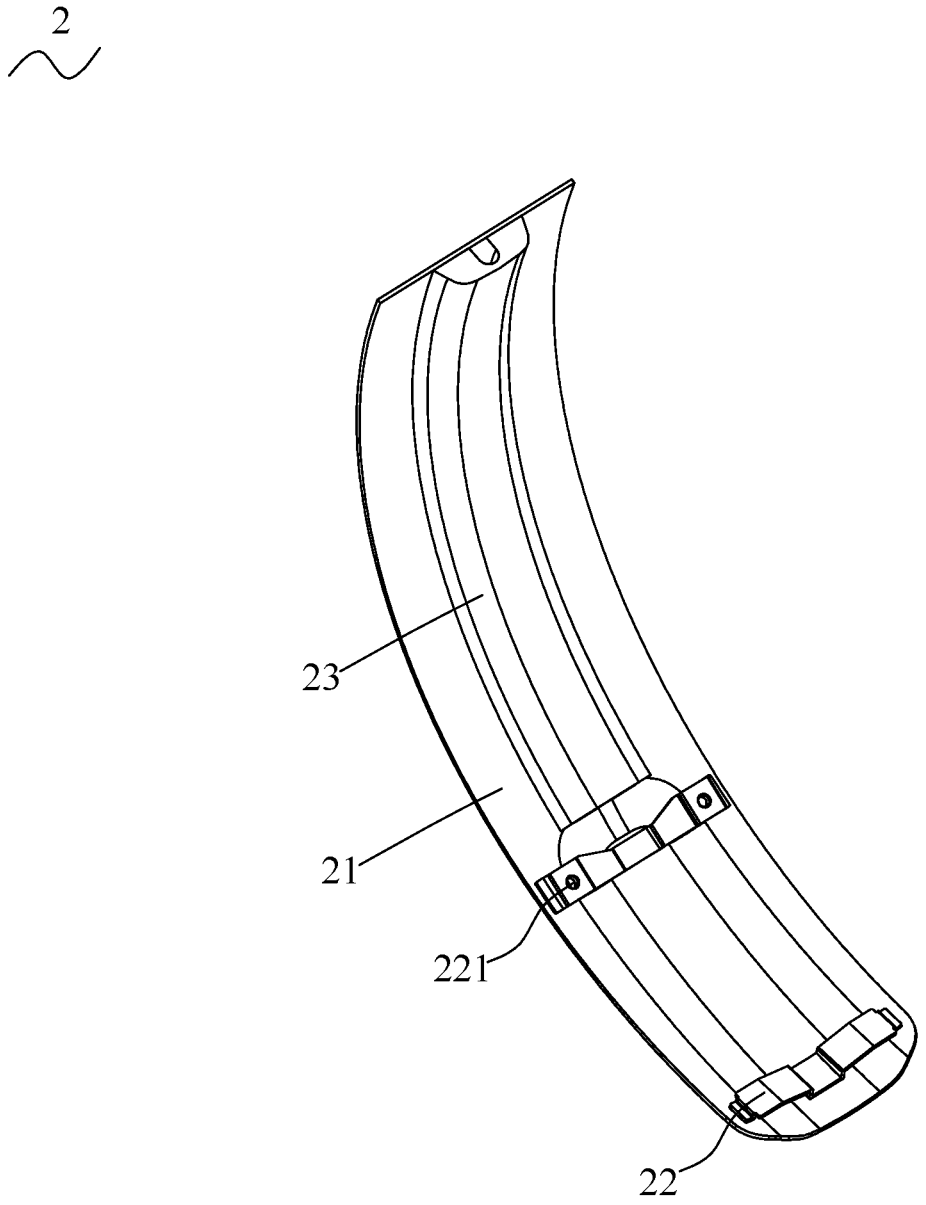
FIG. 7 is a perspective view of a headband set of the headband structure for headphones in this invention.

Referring to FIG. 7, the headband set 2 includes a headband 21, two fixing pieces 22 and a protective pad 23. The fixing pieces 22 are molded to one end of an inner surface of the headband 21, and the protective pad 23 is glued to the other end of the inner surface of the headband 21. The protective pad 23 provides the user a comfortable feeling when wearing the headband structure 100. Two mounting holes 221 are formed respectively at left and right sides of the headband 21 and positioned near the protective pad 23. The second fixing pieces 18 pass through the multi-level holes 145 of the first cap body 14 to enter the positioning perforations 153 of the second cap body 15 and then be fastened in the mounting holes 221 of the fixing pieces 22. In this embodiment, the headband 21 is made of elastomer and the fixing pieces 22 are made of metal.

Figure 4:
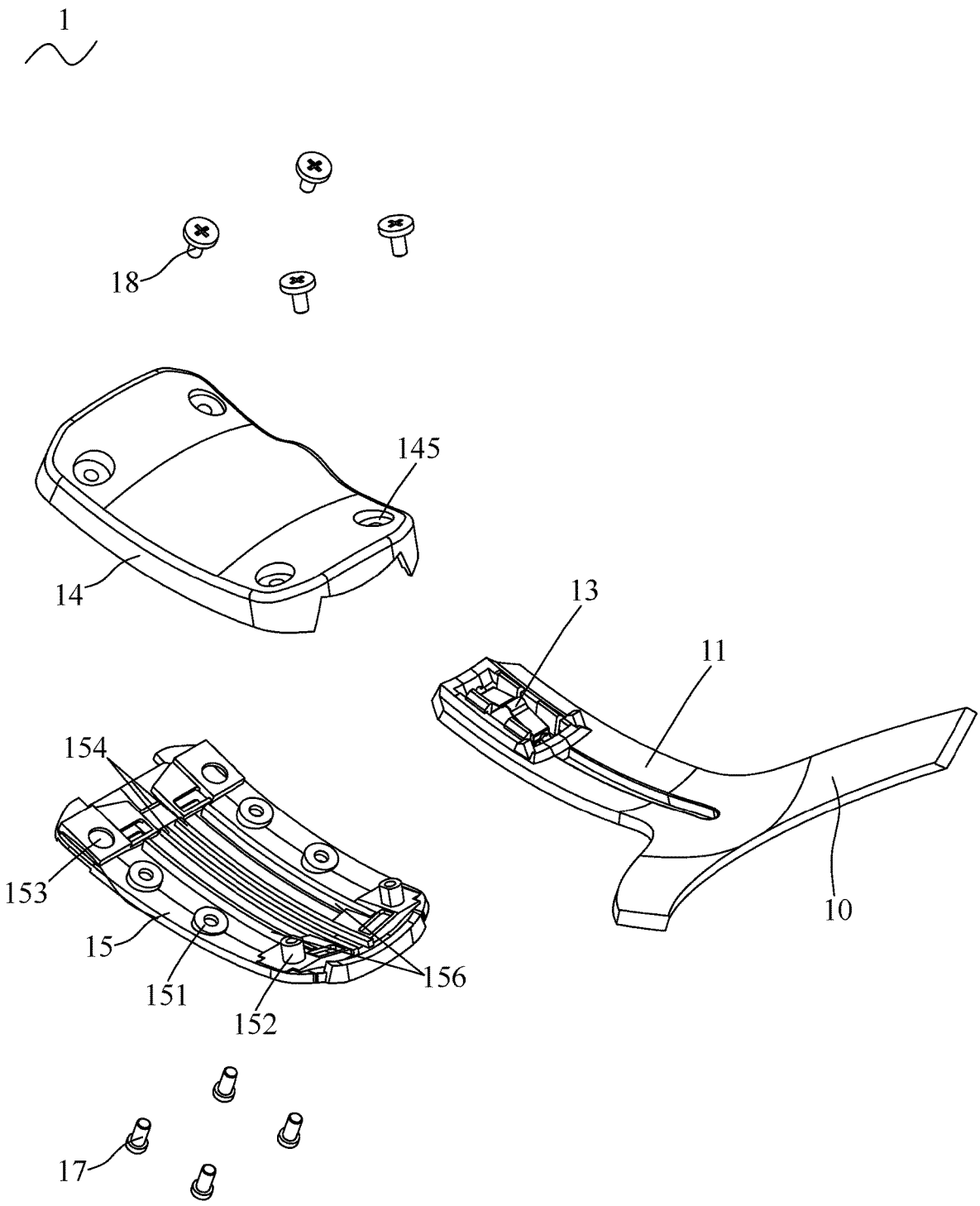
FIG. 4 is an exploded view of the adjustment module of the headband structure for headphones in this invention.
Figure 5:
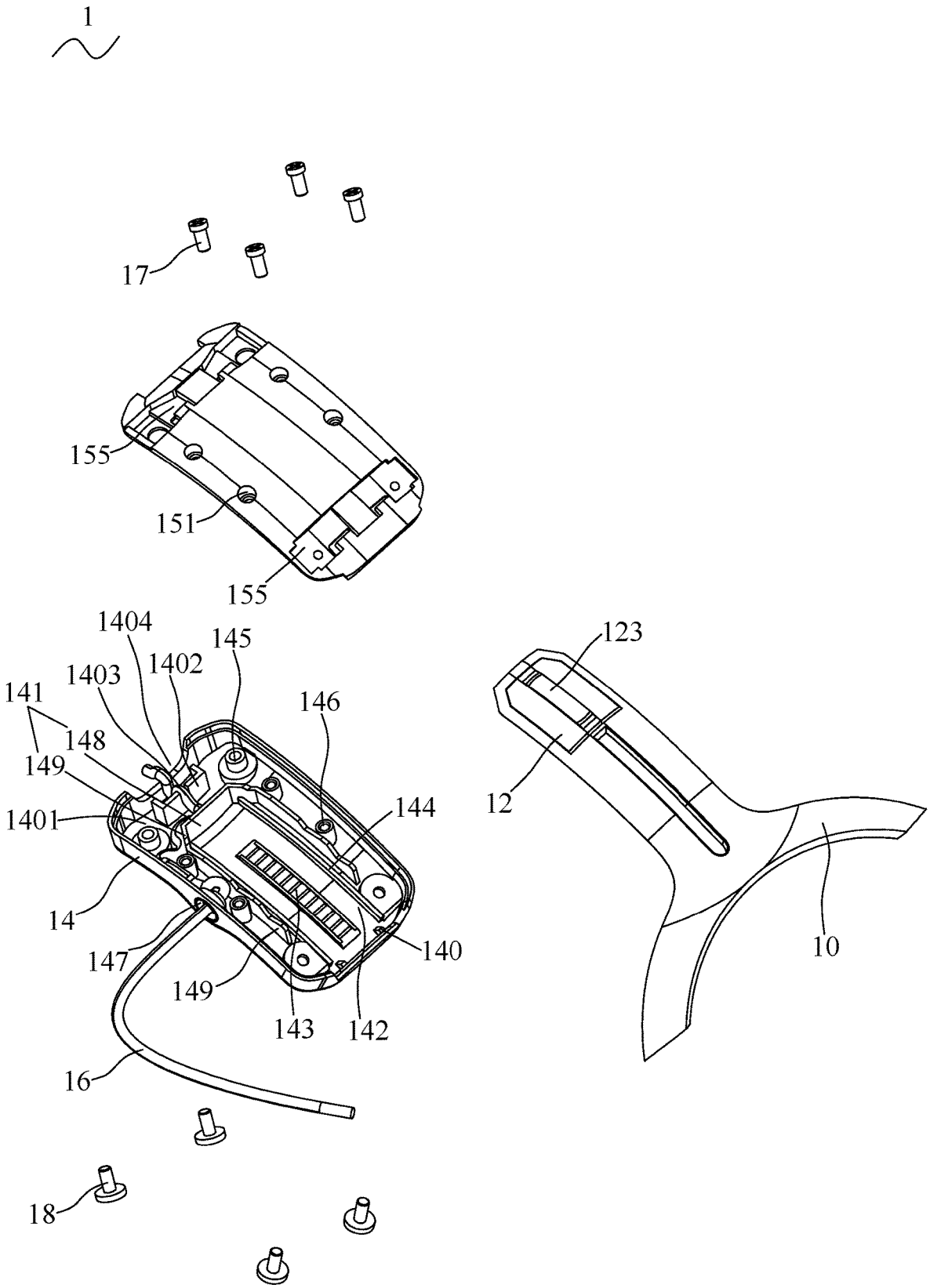
FIG. 5 is another exploded view of the adjustment module of the headband structure for headphones in this invention.
Figure 6:
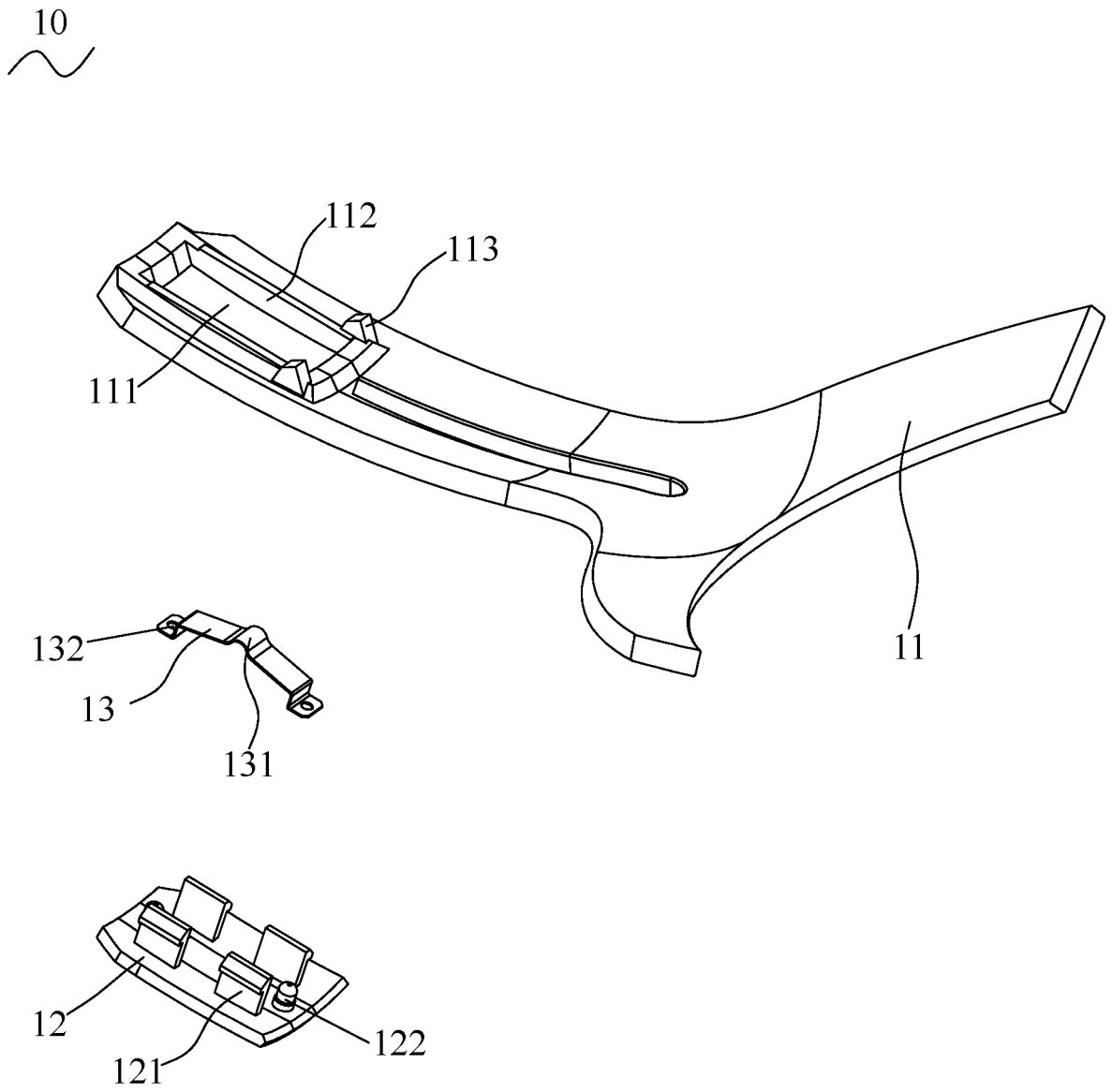
FIG. 6 is an exploded view of an earphone hanger of the headband structure for headphones in this invention.
Figure 8:
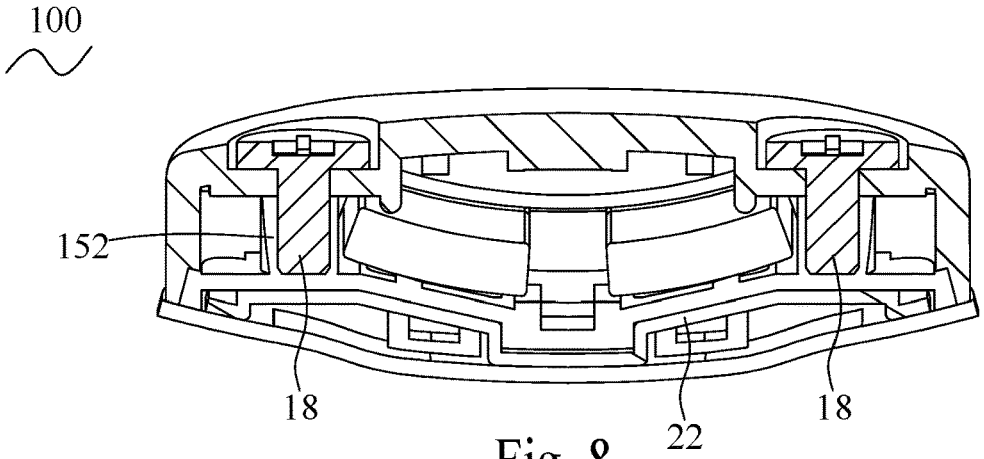
FIG. 8 is a sectional view of the headband structure for headphones along line VIII-VIII in FIG. 1.
Figure 10:
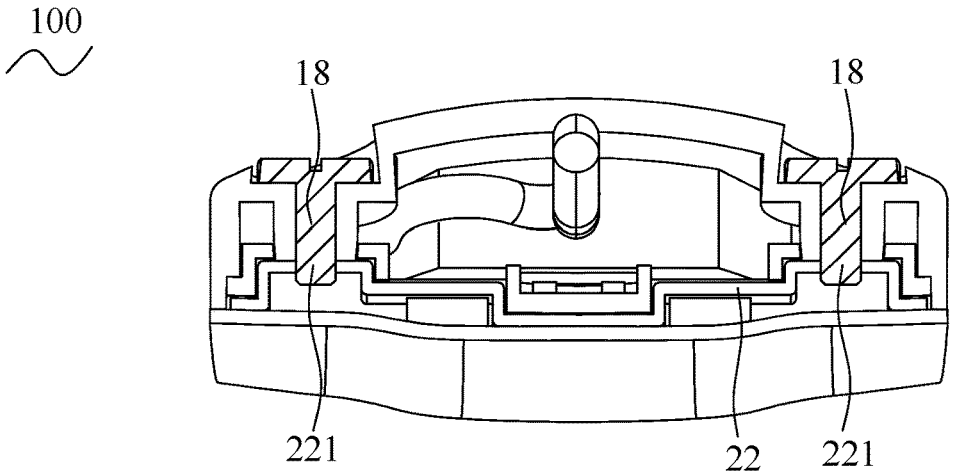
FIG. 10 is a sectional view of the headband structure for headphones along line X-X in FIG. 1.

The assembly processes of the headband structure 100 of the headphones in this invention are described as follow. First, The end of the inner surface of the earphone hanger 10 is arranged in the glide groove 142 of the first cap body 14, and the cable 16 passes through the through hole 147 of the first cap body 14 to enter the first cap body 14 as shown in FIG. 3 to FIG. 5. Then, the second cap body 15 is arranged at an outer surface of the earphone hanger 10, and the first fixing pieces 17 pass through the second positioning parts 151 of the second cap body 15 to be fastened in the first positioning parts 146 of the first cap body 14. And then, two of the second fixing pieces 18 pass through the multi-level holes 145 of the first cap body 14 to be fastened in the third positioning parts 152 of the second cap body 15 as shown in FIG. 8 and FIG. 9 for forming the adjustment module 1. And then, the outer surface of the second cap body 15 is mated with the inner surface of the headband set 2 for clipping the two notches 155 to the two fixing pieces 22. And finally, two of the second fixing pieces 18 pass through the multi-level holes 145 of the first cap body 14 to enter the positioning perforations 153 of the second cap body 15 to be fastened in the mounting holes 221 of the fixing piece 22 as shown in FIG. 10 for forming the headband structure 100 of headphones in this invention. Therefore, the headband set 2 is less likely to deform and thus the adjustment module 1 doesn't create a gap between the contact point of the spring 13 and the wave form fastener 143.

Figure 11:
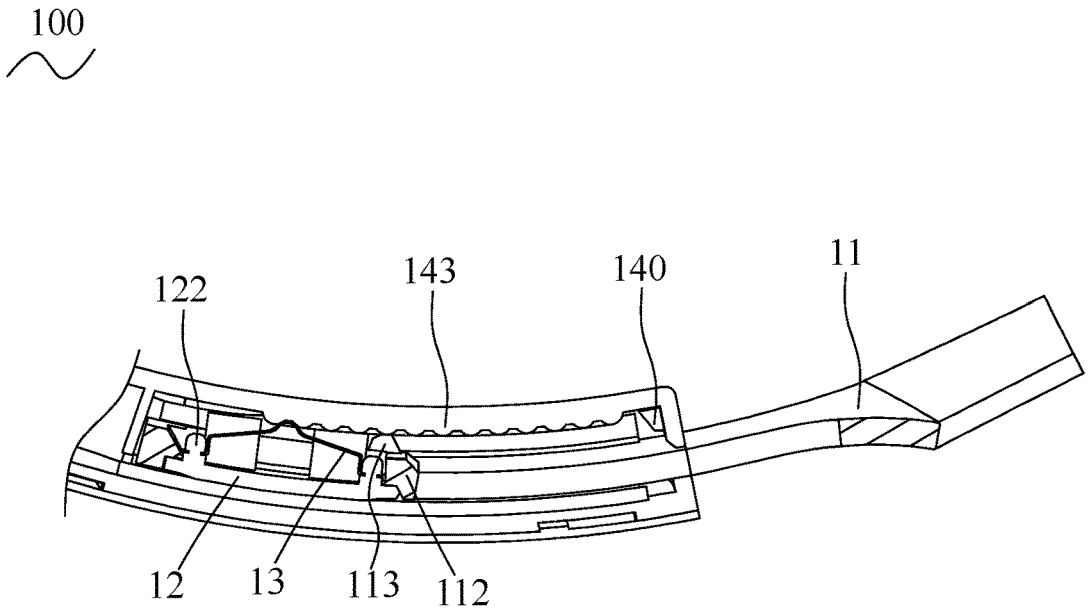
FIG. 11 is a sectional view of the headband structure for headphones, which is folded, along line XI-XI in FIG. 1.

FIG. 11 shows the headband structure 100 in this invention in folded state, the second glide ribs 154 are contacted to the tab 123 of the fixing base 12 for keeping the convex face 131 of the spring 13 to contact with the wave form fastener 143 of the first cap body 14. At this moment, the rear end of the protrusion 112 is still separated with the rear end of the first cap body 14 and the first stop blocks 113 are still separated from the second stop blocks 140. The distance between the rear end of the protrusion 112 and the rear end of the first cap body 14 ensures the adjustment module 1 to be adjustable.

Figure 12:
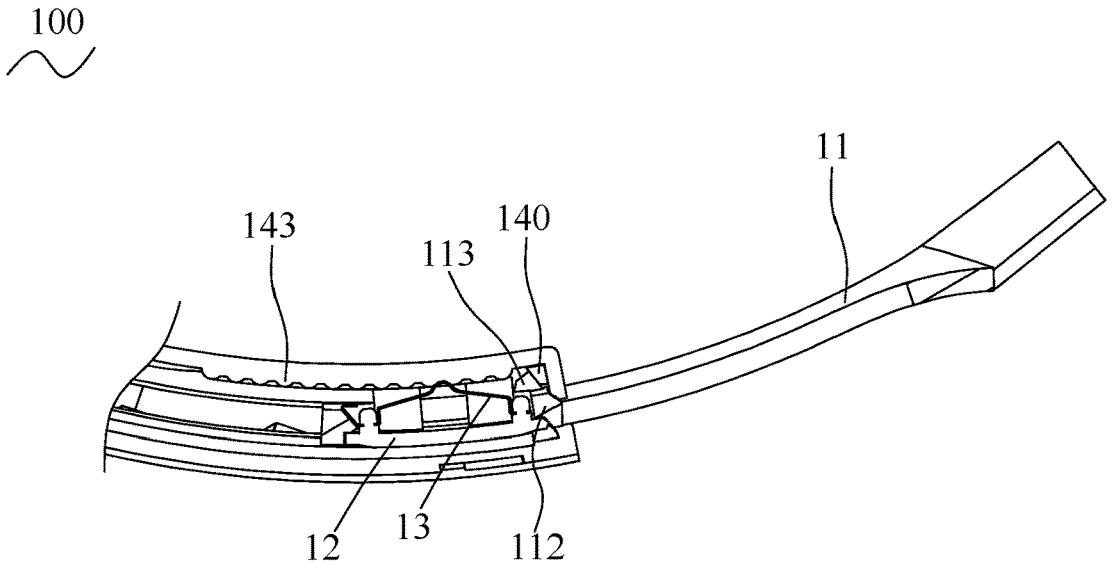
FIG. 12 is a sectional view of the headband structure for headphones, which is expanded, along line XII-XII in FIG. 1.

FIG. 12 shows the headband structure 100 in this invention in expanded state, the second glide ribs 154 are contacted to the tab 123 of the fixing base 12 for keeping the convex face 131 of the spring 13 to contact with the wave form fastener 143 of the first cap body 14. At this moment, the first stop blocks 113 abut against the second stop blocks 140, the rear end of the protrusion 112 abuts against the rear end of the first cap body 14 and stops the adjustment module 1 being stretched furthermore.

In summary, the tab 123 of the fixing base 12 is arranged to abut against the second glide ribs 154 of the second cap body 15 to keep the convex face 131 of the spring 13 contacting with the wave form fastener 143 of the first cap body 14, which improves the feel of touch by enhancing the clamping point between the convex face 131 of the spring 13 and the wave form fastener 143 of the first cap body 14. When the headband structure 100 in this invention is folded, the convex face 131 of the spring 13 is contacted with the wave form fastener 143 of the first cap body 14. In this moment, the rear end of the protrusion 112 is still separated from the rear end of the first cap body 14 and the first stop blocks 113 are still separated from the second stop blocks 140. The distance between the rear end of the protrusion 112 and the rear end of the first cap body 14 ensures the adjustment module 1 to be adjustable. When the headband structure 100 in this invention is expanded, the convex face 131 of the spring 13 is contacted with the wave form fastener 143 of the first cap body 14. In this moment, the first stop blocks 113 abut against the second stop blocks 140, the rear end of the protrusion 112 abuts against the rear end of the first cap body 14 and stops the adjustment module 1 being stretched furthermore. Therefore, the headband structure 100 of headphones in this invention has a better sense of touch.

What is claimed is:

1. A headband structure for headphones, comprising:

a headband set; and an adjustment module arranged at an end of the headband set, wherein the adjustment module has:

an earphone hanger which has a hanger frame, a fixing base arranged at an end of the hanger frame, a spring arranged on the fixing base and a convex face arranged on the spring;

a first cap body arranged at a side of the earphone hanger;

a wave form fastener arranged on the first cap body to contact with the convex face;

a second cap body arranged at another side of the earphone hanger; and a sliding space formed between the first cap body and the second cap body for accommodating the end of the earphone hanger.

2. The headband structure for headphones as claimed in claim 1, wherein a plurality of positioning holes are formed on the spring, a plurality of positioning pillars are arranged on the fixing base, and the positioning pillars go through the positioning holes.

3. The headband structure for headphones as claimed in claim 1, wherein a slot is formed at the end of the hanger frame, the fixing base is arranged next to the slot, a protrusion is extended toward the first cap body from an inner surface of the hanger frame, the protrusion is formed in a rectangular shape and arranged to surround the slot, a plurality of positioning hooks are extended toward the first cap body from an inner surface of the fixing base and the positioning hooks are clipped on left and right sides of the protrusion for securing the fixing base on the hanger frame.

4. The headband structure for headphones as claimed in claim 3, wherein at least a first stop block is extended toward the first cap body from an end of the protrusion, and at least a second stop block is extended toward the hanger frame from a side of an inner surface of the first cap body to mate with the first stop block.

5. The headband structure for headphones as claimed in claim 1, wherein the first cap body has a stopper rib, a glide groove, the wave form fastener, a plurality of first glide ribs, a plurality of multi-level holes, a plurality of first positioning parts and a through hole, the stopper rib is arranged at a middle of the first cap body, the stopper rib has a front wall extended toward the hanger frame and opposite sidewalls extended toward the hanger frame, the front wall and the sidewalls are cooperated with each other to form the glide groove, the end of the earphone hanger is arranged to mate the glide groove, the first glide ribs are extended toward the hanger frame and extended longitudinally along the first cap body and extended inside the glide groove, the wave form fastener is arranged between the first glide ribs, the first glide ribs are arranged on an inner side of the sidewalls, the multi-level holes are recessed toward the hanger frame from front and rear ends of an outer surface of the first cap body, the first positioning parts are extended toward the hanger frame from an inner surface of the first cap body, the first positioning parts are arranged between the multi-level holes, the first positioning parts are formed as hollow cylinders, the through hole is formed at a side surface of the first cap body.

6. The headband structure for headphones as claimed in claim 5, wherein the second cap body includes a plurality of second positioning parts, a plurality of third positioning parts, a plurality of positioning perforations, a plurality of second glide ribs, and a plurality of third glide ribs, the second positioning parts are extended toward the hanger frame from opposite sides of an inner surface of the second cap body to mate with the first positioning parts, the third positioning parts are extended toward the hanger frame from the opposite sides of the inner surface of the second cap body, the positioning perforations are formed to pass through the opposite sides of the inner surface of the second cap body, the third positioning parts and the positioning perforations are arranged to mate with the multi-level holes, the second glide ribs are extended toward the hanger frame and extended longitudinally along the second cap body from the inner surface of the second cap body to be positioned between the second positioning parts and the third positioning parts, a tab is extended toward the second cap body from an outer surface of the fixing base to contact with the second glide ribs, the third glide ribs are extended toward the hanger frame and extended longitudinally along the second cap body from the inner surface of the second cap body, the second glide ribs are arranged at an inner side of the third glide ribs.

7. The headband structure for headphones as claimed in claim 6, further comprising a plurality of first fixing pieces arranged to pass through the second positioning parts to be fasten in the first positioning parts, and a plurality of second fixing pieces arranged to pass through the multi-level holes to be positioned in the third positioning parts and the positioning perforations.

8. The headband structure for headphones as claimed in claim 7, wherein the headband set includes a headband, two fixing pieces and a protective pad, and the two fixing pieces are molded to an end of an inner surface of the headband, the protective pad is arranged to the other end of the inner surface of the headband, notches are recessed toward the hanger frame from left and right sides of an outer surface of the second cap body to be fasten with the fixing pieces, two mounting holes are formed respectively at left and right sides of the headband and positioned near the protective pad, the second fixing pieces are arranged to pass through the multi-level holes of the first cap body to enter the positioning perforations of the second cap body and to be fastened in the mounting holes of the mounting holes.

9. A headband structure for headphones, comprising:

a headband set; and an adjustment module arranged at one end of the headband set, the adjustment module having:

a hanger frame;

a fixing base arranged at one end of the hanger frame;

a tab arranged at an outer surface of the fixing base;

a spring arranged on an inner surface of the fixing base, which has a convex face;

a first cap body arranged at an inner side of the hanger frame;

a wave form fastener arranged on an inner side of the first cap body to contact with the convex face;

a second cap body arranged at an outer side of the hanger frame;

a plurality of glide ribs arranged at an inner surface of the second cap body to be contacted with the tab; and a sliding space formed between the first cap body and the second cap body for accommodating the end of the hanger frame, the fixing base, and the spring.

10. The headband structure for headphones as claimed in claim 9, wherein a slot is formed at the end of the hanger frame, a protrusion is extended toward the first cap body from an inner surface of the hanger frame, the protrusion is formed in a circle shape and arranged to surround the slot, a plurality of positioning hooks are extended toward the first cap body from the inner surface of the fixing base and the plurality of positioning hooks are clipped on left and right sides of the protrusion, two positioning pillars are extended toward the first cap body from the inner surface of the fixing base and respectively arranged next to a front end and a rear end of the protrusion, two positioning holes are formed on the spring, the positioning pillars are arranged to pass through the positioning holes of the spring.

* * * * *